US011149674B2

(12) United States Patent
Girard et al.

(10) Patent No.: US 11,149,674 B2
(45) Date of Patent: Oct. 19, 2021

(54) METHOD FOR DIAGNOSING A DIGITAL FLOW-CONTROL VALVE OF A HIGH-PRESSURE FUEL INJECTION PUMP

(71) Applicant: VITESCO TECHNOLOGIES GmbH, Hannover (DE)

(72) Inventors: Nicolas Girard, Toulouse (FR); George Weaver, Toulouse (FR); Jérémie Memain, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/259,741

(22) PCT Filed: Jul. 12, 2019

(86) PCT No.: PCT/EP2019/068884
§ 371 (c)(1),
(2) Date: Jan. 12, 2021

(87) PCT Pub. No.: WO2020/012011
PCT Pub. Date: Jan. 16, 2020

(65) Prior Publication Data

US 2021/0180536 A1 Jun. 17, 2021

(30) Foreign Application Priority Data

Jul. 13, 2018 (FR) ..... 1856482

(51) Int. Cl.
*F02D 41/30* (2006.01)
*F02D 41/26* (2006.01)

(52) U.S. Cl.
CPC ..... *F02D 41/30* (2013.01); *F02D 41/26* (2013.01)

(58) Field of Classification Search
CPC ..... F02D 41/26; F02D 41/30; F02M 65/00
See application file for complete search history.

(56) References Cited

U.S. PATENT DOCUMENTS 10,174,697 B2 * 1/2019 Song ..... F02D 41/062
10,221,816 B2 * 3/2019 Perez ..... F17C 9/02
(Continued)

FOREIGN PATENT DOCUMENTS

EP 2 821 632 1/2015
KR 10-2017-0060988 6/2017

OTHER PUBLICATIONS

International Search Report and Written Opinion of the ISA for PCT/EP2019/068884 dated Sep. 16, 2019, 10 pages.

*Primary Examiner* — Carl C Staubach
(74) *Attorney, Agent, or Firm* — Nixon & Vanderhye

(57) ABSTRACT

Disclosed is a method for the diagnosis of a digital valve in a fuel injection system. In the diagnosis, a diagnosis current is applied to the digital valve with an intensity and for a hold time that are predetermined by experiment on digital valves identified as being fault-free, this intensity and this time being recognized as being sufficient for an inflection on a curve of the closing current to be detected in the hold time. Measurements are taken at more than 3 kHz of the diagnosis current added to the induced current in the hold time. When an inflection on the current curve is detected in this hold time, it is concluded that the valve is working correctly. When no inflection on the curve is detected in this hold time, it is concluded that the valve is faulty.

20 Claims, 4 Drawing Sheets

(56) References Cited

U.S. PATENT DOCUMENTS

| | | | | |
|---|---|---|---|---|
| 10,526,993 | B2 * | 1/2020 | Agnus | F02D 41/2477 |
| 10,557,437 | B2 * | 2/2020 | Iwano | F02M 59/466 |
| 2016/0160790 | A1 * | 6/2016 | Pursifull | F02D 41/3845 123/294 |
| 2019/0353110 | A1 * | 11/2019 | Agnus | F02D 41/3845 |
| 2021/0123405 | A1 * | 4/2021 | Faber | F02M 65/00 |

* cited by examiner

METHOD FOR DIAGNOSING A DIGITAL FLOW-CONTROL VALVE OF A HIGH-PRESSURE FUEL INJECTION PUMP

This application is the U.S. nattional phase of International Application No. PCT/EP2019/068884 filed Jul. 12, 2019 which designated the U.S. and claims priority to FR Patent Application No. 1856482 filed Jul. 13, 2018, the entire contents of each of which are hereby incorporated by reference.

BACKGROUND OF THE INVENTION

Field of the Invention

The present invention relates to a method for the functional diagnosis of a digital flow-control valve for a high-pressure fuel injection pump forming part of a system for injecting fuel into an internal combustion engine of a motor vehicle.

The present invention also relates to a method for deblocking such a digital valve.

Description of Related Art

Such a digital control valve controls a flow rate of fuel in the pump by being driven electrically between an open position in which a high-pressure portion of the injection system is not supplied with fuel and a closed position in which the high-pressure portion of the injection system is supplied with the digital valve then being in a fully closed position.

In order to achieve this, a nominal closing control electric current is applied to the digital valve causing it to move toward its closed position and then canceled so that it opens under the action of a return spring, the movement of the digital valve toward its closed position creating an induced current in the digital valve, monitoring the profile of which over time makes it possible to detect a position of start-of-closing of the digital valve and the instant at which this occurs.

In a high-pressure fuel injection system, the fuel is transferred from the low-pressure fuel tank to the high-pressure fuel injection pump by means of a booster pump which operates at low pressure. The pressure of the fuel in a common rail is controlled by means of a PID (proportional, integral, derivative) controller, referred to as the high-pressure fuel injection pump controller which forms part of a control system.

This controller acts in combination with an actuator with which the high-pressure fuel injection pump is equipped, which makes it possible to transfer only as much fuel into the common rail as is necessary according to the amount of fuel required by an engine control unit. In order to do that, this actuator comprises a valve referred to as a DIV valve, or digital inlet valve, that allows the desired quantity of fuel to be transferred into the common rail.

The actuator allows any fuel displaced by the high-pressure fuel injection pump and not wanted in the common rail to be sent back to the supply circuit. The high-pressure fuel injection pump is for example a rotary piston pump that is continuously driven in rotation by the internal combustion engine.

In what follows, the DIV valve will be referred to as a digital valve and its actuator comprising a DIV valve may be referred to hereinafter as a digital valve actuator.

Various diagnostics make it possible to check that the control system forming part of the fuel injection system in a common rail for the injection of fuel into an internal combustion engine of a motor vehicle is operating correctly.

Electrical diagnostics of the digital valve for the detection of hard faults such as open-circuit or short-circuit faults are known in particular. Functional diagnostics of the control system based on observing the deviation between the value of the pressure and a pressure setpoint or by observing the drift of the proportional, integral, derivative controller are also known.

Aside from the case of electrical faults, these diagnostics do not allow a specific component of the system to be blamed in particular, for example the high-pressure pump, the digital valve, the low-pressure circuit, the high-pressure circuit or an injector.

One cause of the high-pressure pump not functioning is when a digital control valve is blocked in the open or closed position. This blocking may result, for example, from a particle released for example, but not only, by components of the fuel supply circuit upon starting the engine. When the digital valve is blocked, the high-pressure pump cannot generate pressure and the engine cannot start.

Currently, to determine whether the digital valve is the offending element, this component has to be dismounted and an analysis performed on a dedicated test bench, which requires expensive special equipment and several operations such as dismounting, packaging, shipping, mounting on the test bench and analysis of the result.

SUMMARY OF THE INVENTION

The problem underlying the present invention is, in a fuel injection system of an internal combustion engine of a motor vehicle, that of performing a diagnosis on the digital flow-control valve for a high-pressure fuel injection pump without having to dismount it from the injection system.

To that end, the present invention relates to a method for the functional diagnosis of a digital flow-control valve for a high-pressure fuel injection pump forming part of a system for injecting fuel into an internal combustion engine of a motor vehicle, the digital control valve controlling a flow rate of fuel in the pump by being electrically driven between an open position, with the digital valve then taking an open position, in which a high-pressure portion of the injection system is not supplied with fuel, and a closed position in which the high-pressure portion of the injection system is supplied with the digital valve taking a closed position, a nominal closing control electric current being applied to the digital valve causing it to move toward its closed position and then canceled so that it opens under the action of a return spring, the movement of the digital valve toward its closed position creating an induced current in the digital valve, noteworthy in that, in the diagnosis:

- a closing diagnosis control current is applied to the digital valve, which closing diagnosis control current is different from the nominal control current with an intensity and for a hold time that are predetermined beforehand by experiment on digital valves identified as being fault-free, this intensity and this time being recognized as being sufficient for an inflection on a curve of the closing current added to the induced current to be detected in the hold time predetermined for these fault-free digital valves,
- measurements are taken at a high frequency higher than 3 kHz of the diagnosis current added to the induced current flowing through a digital valve to be diagnosed in the predetermined hold time with an at least partial plot of the current curve and, when an inflection on the current curve is detected in this predetermined hold time, it is concluded that the digital valve is operating normally while, when no inflection on the current curve is detected in this predetermined hold time, it is concluded that the digital valve is faulty.

The predetermined intensity of the current and the predetermined hold time depend on the type of digital valve and remain the choice of the person skilled in the art who can determine them by experiment on fault-free digital valves. The hold time of a diagnostic current is advantageously longer than the hold time of a nominal control current in order to reveal the inflection on a curve of current intensity with time and even to see whether an inflection appears after the hold time associated with a nominal control current.

The diagnostic method involves technical elements such as the application of a control current to the digital valve with measurements at a high frequency higher than 3 kHz of the diagnostic current added to the induced current flowing through a digital valve to be diagnosed and an at least partial plot of the current curve. This diagnostic method may be followed by a method for deblocking the digital valve.

The technical effect obtained is that of determining whether or not a digital valve is faulty without dismounting the injection system and by means of a function implemented in a control unit internal to the vehicle or external to the vehicle, for example by means of a diagnostic connector commonly referred to as OBD. This makes it possible to avoid any cumbersome and expensive management due to dismounting the entire injection system. Such a diagnostic method has an undeniable technical character and may be followed by various methods for unsticking the digital valve if need be.

In the event of doubt as to whether a digital valve is operating correctly, the method according to the invention, advantageously implemented in the control computer of the injection system, makes it possible to diagnose the digital valve in order to ensure that it is operating correctly even and preferably when the engine is stopped, which allows a result to be obtained in the event that the engine does not start due to lack of pressure in a common injection rail.

At the same time as a diagnostic current is applied to the digital valve, it is measured at a high frequency, for example 10 kHz, the actual current flowing through the digital valve resulting from the control current and the current induced by the movement of the digital valve. Analyzing this current makes it possible to detect an inflection of the current induced by the digital valve in its closing movement, proving that this movement is then indeed taking place.

Failure to detect this inflection means that the digital valve has not reached its closed position, which is a fault. Equally, detecting this inflection outside of a time window defined by the predetermined hold time means that the operation of the digital valve is not optimal.

The diagnosis is quickly established in a few seconds. This diagnosis is centered on the digital valve and makes it possible to know for example for a faulty injection system whether the digital valve is or is not responsible for this fault, without dismounting the system. No other special tool is required.

Advantageously, the diagnosis current is maintained after an end of the predetermined hold time for a predetermined additional time, and, on the one hand, when no inflection on the current curve is detected in the predetermined hold time and the predetermined additional time, it is concluded that the digital valve has a first type of fault, a closing movement of the digital valve not having taken place or not having been sufficient to position the digital valve in the closed position, while, on the other hand, when no inflection on the current curve is detected in the predetermined hold time but one is detected in the predetermined additional time, it is concluded that the digital valve has a second type of fault, a closing movement of the digital valve having taken place too late.

The hold time may be longer than the nominal hold time in standard operation of the digital valve. This hold time may even be extended by an additional time in order to see whether an inflection appears outside of the hold time, which is also a fault but one different from that of the digital valve not moving.

Advantageously, a decrease in current intensity in the inflection is measured and, when this decrease in intensity is smaller than a predetermined inflection decrease threshold, it is concluded that the digital valve has a third type of fault.

The inflection decrease threshold may for example be 5% of the intensity of the current then reached, any smaller decrease not being significant. This inflection decrease may be due to too much resistance in the current control circuit or a faulty fuse of the digital valve.

Advantageously, the predetermined intensity of the diagnosis current is higher than a first, low threshold predetermined by experiment that is sufficient to cause the digital valve to move into the closed position and lower than a predetermined second, high threshold in order to ensure electrical protection of the valve and the control thereof, the predetermined hold time of a diagnosis control current being longer than the hold time of a nominal control current in normal operation of the digital valve.

Advantageously, the diagnosis current applied to the digital valve when it is closed is in the form of a plurality of peak-and-hold electrical pulses for a determined number of segments according to pulse-width modulation.

Advantageously, the determined number of segments is smaller than 40 and the peak-and-hold is for four milliseconds, the high-frequency measurement of the current taking place at 10 kHz.

Advantageously, the method is initiated upon an external request in aftersales or in a garage, upon a periodic routine request or upon a request initiated following a possible fault detected in the injection system.

The method may be initiated either externally using a tool at the end of the production line or in aftersales, or automatically internally based on the performance of the pump control, which is an important integral part of the system, following a control diagnosis, or periodically at a defined operating point of the engine such as when the engine is stopped, started or restarted.

Advantageously, the method is implemented with the engine of the motor vehicle running or stopped, with, in the latter case, a battery voltage of the motor vehicle, called upon to supply the diagnosis current, in a range between +/−20% of a nominal voltage of the battery.

Implementing the method with the engine running makes it possible to detect whether or not the digital valve closes too late, thus detecting the start of seizing up.

The battery, via the engine computer managing the maximum current intensity at the output of the battery, has to ensure a minimum voltage for the diagnostic current but should not deliver too high a voltage delivering a current with an intensity higher than 16 amps, which could damage the digital valve control.

The invention relates to a method for deblocking a digital flow-control valve for a high-pressure fuel injection pump forming part of a system for injecting fuel into an internal combustion engine of a motor vehicle, noteworthy in that the deblocking method incorporates such a method for the diagnosis of the digital valve and, when it is concluded that the digital valve has a fault in the diagnosis method, a step of deblocking the digital valve is performed.

Advantageously, the digital valve is subjected to an unsticking control current applied in three consecutive phases having respective durations with, in a first phase, a current varying from a minimum value to a maximum value, in a second phase, a current varying between the maximum value and a freewheeling value and, in a third phase, a current varying between the freewheeling value and the minimum value.

This method may be repeated several times in a row and is particularly well suited to a digital valve blocked by one or more particles thereinside.

The invention lastly relates to a system for injecting fuel into an internal combustion engine of a motor vehicle comprising a high-pressure fuel injection pump and a control unit, the pump comprising at least one piston moving in a chamber and being equipped with a digital valve for controlling a fuel flow rate and driven by the control unit via an electrical control element connected to the digital valve by an electrical circuit and producing a nominal closing control electric current, the system implementing such a method for the functional diagnosis of a digital flow-control valve or such a method for deblocking a digital valve, noteworthy in that the electrical control element comprises means for varying the intensity and the hold time of the nominal current for application of a diagnosis current, the control unit comprising means for measuring the diagnosis current at a high frequency higher than 3 kHz, means for detecting an inflection on a diagnosis current curve and means for establishing a diagnosis of a fault or otherwise in the digital valve.

BRIEF DESCRIPTION OF THE DRAWINGS

Other features, aims and advantages of the present invention will become apparent from reading the detailed description that follows and from examining the appended drawings given by way of non-limiting example, and in which.

DESCRIPTION OF THE PREFERRED EMBODIMENTS

In what follows, reference will be made to all of the figures taken in combination, pointing out some of these figures in particular.

Figure 1:
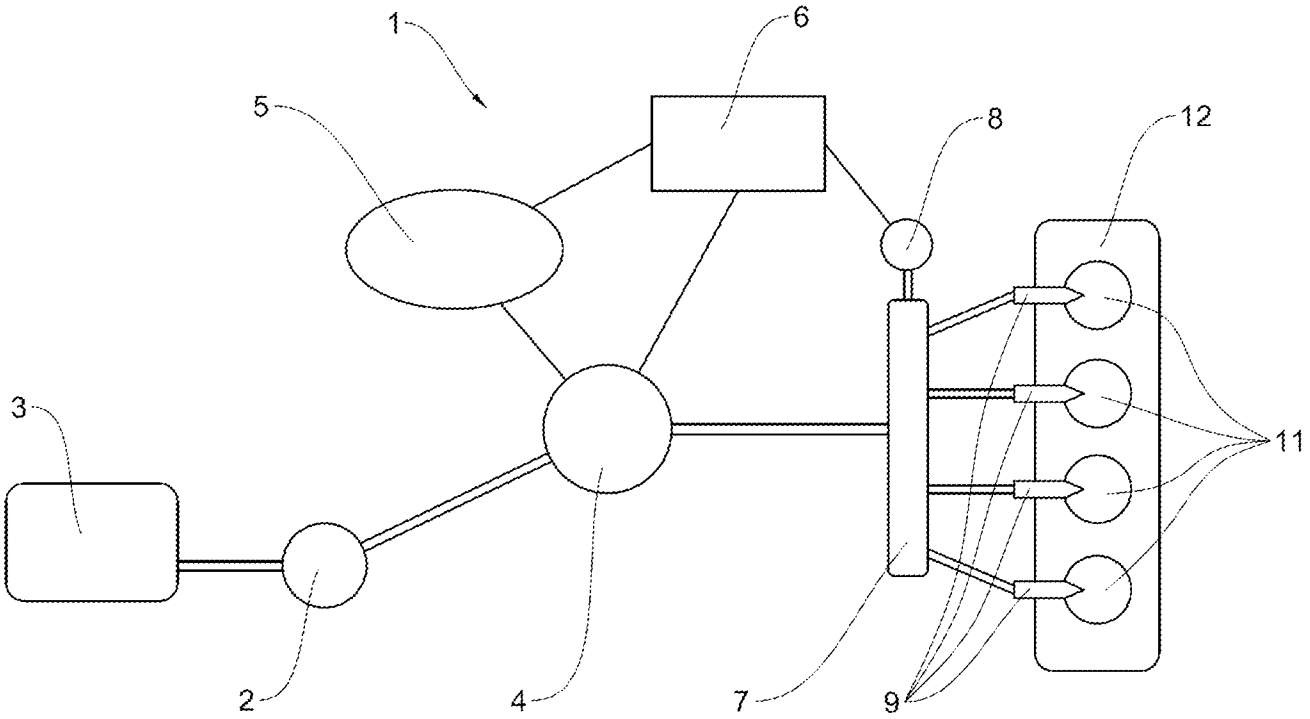
FIG. 1 schematically shows a view of one embodiment of a high-pressure fuel supply system for an internal combustion engine, this system being equipped with a high-pressure fuel injection pump and a digital valve, the correct operation of which may be estimated according to a diagnostic method according to the present invention, FIG. 2 schematically shows a view in cross section of a high-pressure fuel injection pump provided with a digital valve on which the method for the diagnosis of a digital valve according to the present invention may be implemented, FIGS. 3 and 4 each show a respective curve of current intensity measured by oscilloscope with time for a correctly operating digital valve and a blocked incorrectly operating digital valve, respectively, an inflection being visible for the curve of the correctly operating digital valve and not being visible for the curve of the blocked digital valve, the curves being established in accordance with a diagnostic method according to the present invention.
Figure 2:
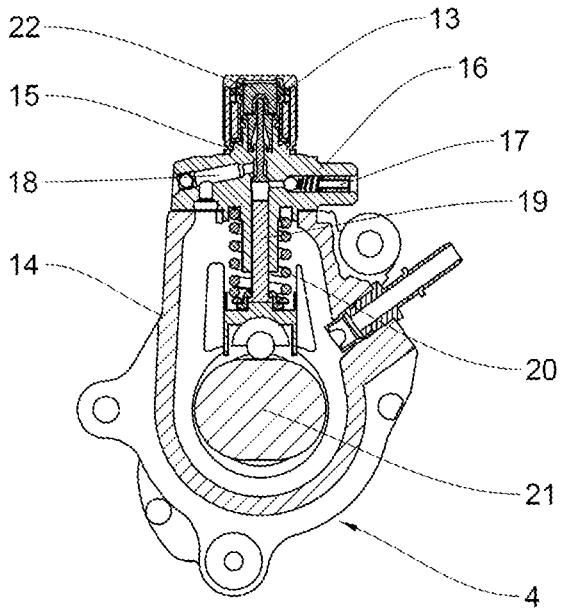

Referring more particularly to FIGS. 1 and 2, a high-pressure fuel injection system 1 for an internal combustion engine comprises a booster pump 2 which takes fuel at low pressure from a low-pressure fuel tank 3, a high-pressure fuel injection pump 4 being fed by the booster pump 2. This high-pressure pump 4 comprises an actuator for a digital valve, which actuator is not shown in FIG. 1 but is shown in FIG. 2 which will be discussed in detail later.

The injection system 1 also comprises a controller for the high-pressure fuel injection pump 4 and, more particularly, for the digital valve actuator and means for activating the high-pressure injection pump 4 by time-based control or angular control using the high-pressure fuel injection pump 4 controller 5 and an engine control unit 6, time-based control being mainly used just after the starting of the motor vehicle. The controller 5 may also be integrated into the engine control unit 6 and not be embodied as shown in FIG. 1.

The injection system 1 also comprises a high-pressure fuel tank or common rail 7 fed by the high-pressure fuel injection pump 4, the common rail 7 being provided with means 8 for measuring pressure. Injectors 9 are fed with fuel by the common rail 7 and controlled by the engine control unit to inject fuel into the cylinders 11 of the internal combustion engine 12.

The high-pressure fuel injection pump 4 may be able to be driven in a known way by a drive means, not shown in FIG. 1, using the internal combustion engine 12, for example using a mechanical transmission linking mechanism of chain, gear, belt or similar type.

FIG. 2 shows a high-pressure fuel injection pump 4 for the injection system shown in FIG. 1. This pump 4 comprises a pump housing 14. The housing 14 of the pump 4 houses within it a piston 19 returned by a spring 20, the piston 19 being driven by a cam drive mechanism 21.

The pump housing 14 at its upper end has a displacement unit 15 housing a digital valve 13 or DIV valve. The unit 15 comprises a supply and return pipe 18 from and to the booster pump and an outlet pipe 17 leading toward the common rail, this outlet pipe comprising a non-return valve 16.

When the digital valve 13 is in the open position, the piston 19 draws fuel from the supply pipe 18 into a cylinder while the non-return valve 16 of the outlet pipe 17 is closed.

At the end of the filling phase, the digital valve 13 is still in the open position, the piston 19 drives the fuel in the supply pipe 18 toward the booster pump, namely the low-pressure portion of the injection system, while the non-return outlet valve 16 of the outlet pipe 17 remains closed. That allows excess fuel to be carried back into the low-pressure portion of the injection system.

Next, the digital valve 13 is electrically controlled so as to close, the supply pipe 18 then being closed, the piston 19 drives the fuel in the outlet pipe 17 toward the common rail, namely toward the high-pressure portion of the injection system, the non-return valve 16 of the outlet pipe 17 then being open.

Referring more particularly to FIGS. 1 to 5, the present invention relates to a method for the functional diagnosis of a digital flow-control valve 13 for a high-pressure fuel injection pump forming part of a system 1 for injecting fuel into an internal combustion engine of a motor vehicle.

As previously mentioned, the digital control valve controls a flow rate of fuel in the pump by being electrically driven between, on the one hand, an open position, with the digital valve 13 then taking an open position and, on the other hand, a closed position.

When the digital valve 13 is in the open position, a high-pressure portion of the injection system 1 is not supplied with fuel. In the closed position which corresponds to a position in which the digital valve 13 is closed, the high-pressure portion of the injection system 1 is supplied.

A nominal closing control electric current is applied to the digital valve 13 causing it to move toward its closed position and then canceled so that it opens under the action of a return spring. The return to open does not happen automatically as soon as the closing control current ends because the return spring must overcome the pressure of the piston 19.

The movement of the digital valve 13 toward its closed position under application of the closing control current creates an induced current in the digital valve 13 that is representative of the closing movement of the digital valve 13.

This is the normal operation of a digital valve 13 subjected to a nominal control current for a nominal time. The operating conditions change, however, when a method for the diagnosis of the digital valve 13 according to the present invention is implemented.

When such a method is implemented on a digital valve 13 to be diagnosed, a closing diagnosis control current is applied to the digital valve 13. This diagnosis control current differs from the nominal control current in its intensity, which is predetermined, but above all in its predetermined hold time Dmain.

Specifically, routine experiments are performed on digital valves identified as fault-free in which control currents are applied at various intensities and for various hold times. A current intensity high enough to effect closure but low enough not to electrically damage the digital valve 13 and its control system should be chosen. Additionally, a hold time Dmain long enough to effect, for all the fault-free digital valves, valve closure, and even to detect delayed closing, should be chosen.

Since a closing movement of the valve produces an induced current, this movement results in an inflection 23 on a curve of the closing current added to the induced current in the hold time Dmain predetermined for these fault-free digital valves. Those skilled in the art have the skills to choose a predetermined current intensity and a hold time Dmain for the current that are sufficient to effect closure of a fault-free digital valve 13. The current hold time Dmain may be selected so as to be higher than a nominal hold time Dmain resulting in the closure of the digital valve 13, this nominal hold time being decreased as substantially as possible in order to save on electrical power consumption.

From this starting point, measurements are taken at a high frequency higher than 3 kHz of the diagnosis current added to the induced current flowing through a digital valve 13 to be diagnosed in the predetermined hold time Dmain. An at least partial plot of the current curve is then made. What is meant by at least partial plot is that it is not necessary to plot the entire current curve but only a portion of the curve for which the closing movement of the digital valve 13 is taking place and which is likely to exhibit an inflection 23.

When an inflection 23 on the current curve is detected in this predetermined hold time Dmain, it is concluded that the digital valve 13 is operating normally, this digital valve 13 being in good working order. This is the case in FIG. 3 where an inflection 23 is visible on the current curve I with time t.

When no inflection 23 on the current curve is detected in this predetermined hold time Dmain, it is concluded that the digital valve 13 is faulty. This is the case in FIG. 4 for which no inflection 23 on the current curve I with time t is visible.

Figure 5:
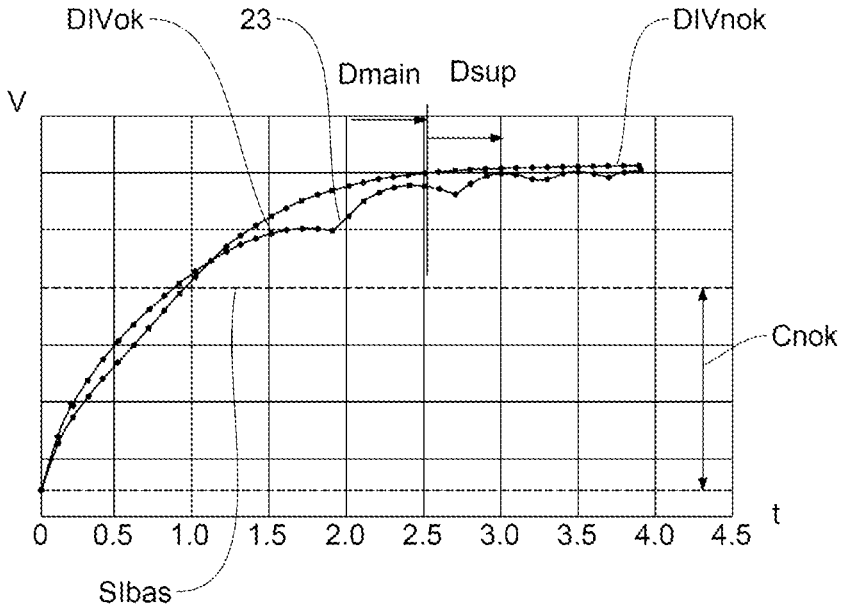
FIG. 5 shows two readback curves with time of an intensity of the current that has passed through the digital valve, the current having a control current component and an induced current component, one readback curve corresponding to a correctly operating digital valve in exhibiting an inflection and the other corresponding to an incorrectly operating digital valve.

FIG. 5, while referring to FIG. 2, shows two control current readback curves of a digital valve 13 via a specific acquisition mode. On the abscissa, the time t is graduated every 0.5 milliseconds, a total hold time being approximately for 4 milliseconds. On the ordinate, a dimensionless quantity V is indicated, measured by an acquisition stage of the computer. A correspondence may be established between the graduations of the quantity V and a current intensity, one graduation of the scale on the ordinate corresponding to 2 amps and the total scale on the ordinate corresponding to 12 amps maximum.

A current curve of a fault-free digital valve 13, or DIVok, which exhibits an inflection region 23, and a curve of a faulty digital valve 13, or DIVnok, which does not exhibit an inflection region 23, are shown. A plurality of inflection regions 23 may be present on the same curve. For example, the current curve of a fault-free digital valve 13 DIVok may exhibit four inflection regions of consecutive decreasing amplitude as the curve progresses, but only the first inflection region 23 is taken into account, the other inflection regions being echoes.

In this FIG. 5, the predetermined hold time Dmain is shown, the arrow to the left representing its end. This predetermined hold time Dmain may be extended by an additional predetermined time Dsup in order to see whether an inflection region appears after the end of the predetermined hold time Dmain, which does not occur in FIG. 5. The end of the predetermined additional time Dsup is not shown in FIG. 5 because it is calibratable. In the non-limiting example shown in FIG. 5, the predetermined hold time Dmain is 2.5 milliseconds and the additional predetermined time Dsup may be 1.50 milliseconds to reach a total current hold and plot time for the curve of 4 milliseconds.

Thus, the diagnosis current may be maintained after an end of the predetermined hold time Dmain for a predetermined additional time Dsup. When no inflection 23 on the current curve is detected in the predetermined hold time Dmain and the predetermined additional time Dsup, it is concluded that the digital valve 13 has a first type of fault. In this case, a closing movement of the digital valve 13 has not taken place or has not been sufficient to position the digital valve 13 in the closed position.

When no inflection 23 on the current curve is detected in the predetermined hold time Dmain but one is detected in the predetermined additional time Dsup, it is concluded that the digital valve 13 has a second type of fault. In this case, a closing movement of the digital valve 13 has taken place too late or too slowly. This is not shown in FIG. 5.

This may be due to a hard point and is not conceivable in nominal operation because the control current is time-limited and the nominal control hold time is shorter than the predetermined hold time. The nominal control current may thus be canceled before the digital valve is closed.

The predetermined additional time Dsup may be equal to at least 10% of the predetermined hold time Dmain. In the example of FIG. 5, the predetermined additional time Dsup is equal to 60% of the predetermined hold time Dmain.

The predetermined hold time Dmain of a diagnosis control current may be longer than the hold time of a nominal control current in normal operation of the digital valve 13, in order to read back the inflection 23 during the closure of the digital valve 13, the nominal control current potentially being stopped before the appearance of this inflection.

When a decrease in current intensity in the inflection 23 is measured and, when this decrease in intensity is smaller than a predetermined inflection decrease threshold, for example less than 7%, advantageously less than 5%, it is concluded that the digital valve 13 has a third type of fault. This third fault is due to an electrical problem caused by high electrical resistance.

Still referring mainly to FIG. 5, the predetermined intensity of the diagnosis current should be higher than a first, low threshold Sibas predetermined by experiment as sufficient to cause the digital valve 13 to move into the closed position. This is shown in FIG. 5 for a current intensity of between 1 and 8 amps which is a current region Cnok not suitable for the implementation of the method because it is too low, being lower than the predetermined first, low threshold Sibas which may be 8 amps.

In addition, the predetermined intensity of the diagnosis current may be lower than a predetermined second, high threshold in order to ensure electrical protection of the valve and the control thereof. This threshold may be 16 amps.

Figure 3:
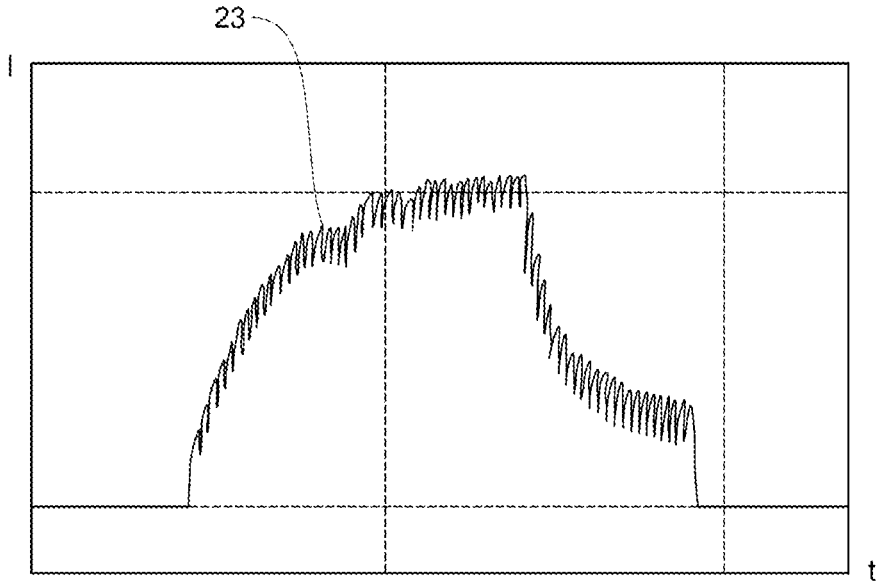
Figure 4:
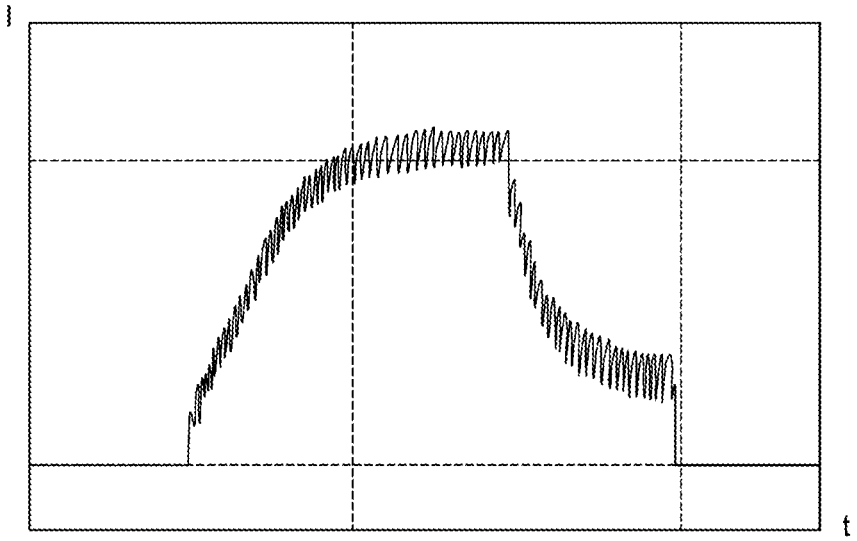

As can be seen more particularly in FIGS. 3 and 4, the diagnosis current applied to the digital valve 13 when it is closed may be in the form of a plurality of peak-and-hold electrical pulses for a determined number of segments according to pulse-width modulation.

The determined number of segments may be smaller than 40 and the peak-and-hold may be for four milliseconds, the high-frequency measurement of the current possibly taking place at 10 kHz, which is the case in FIGS. 3 and 4. The 90% pulse-width modulation may be performed over a predetermined hold time of 4 milliseconds.

Figure 6:
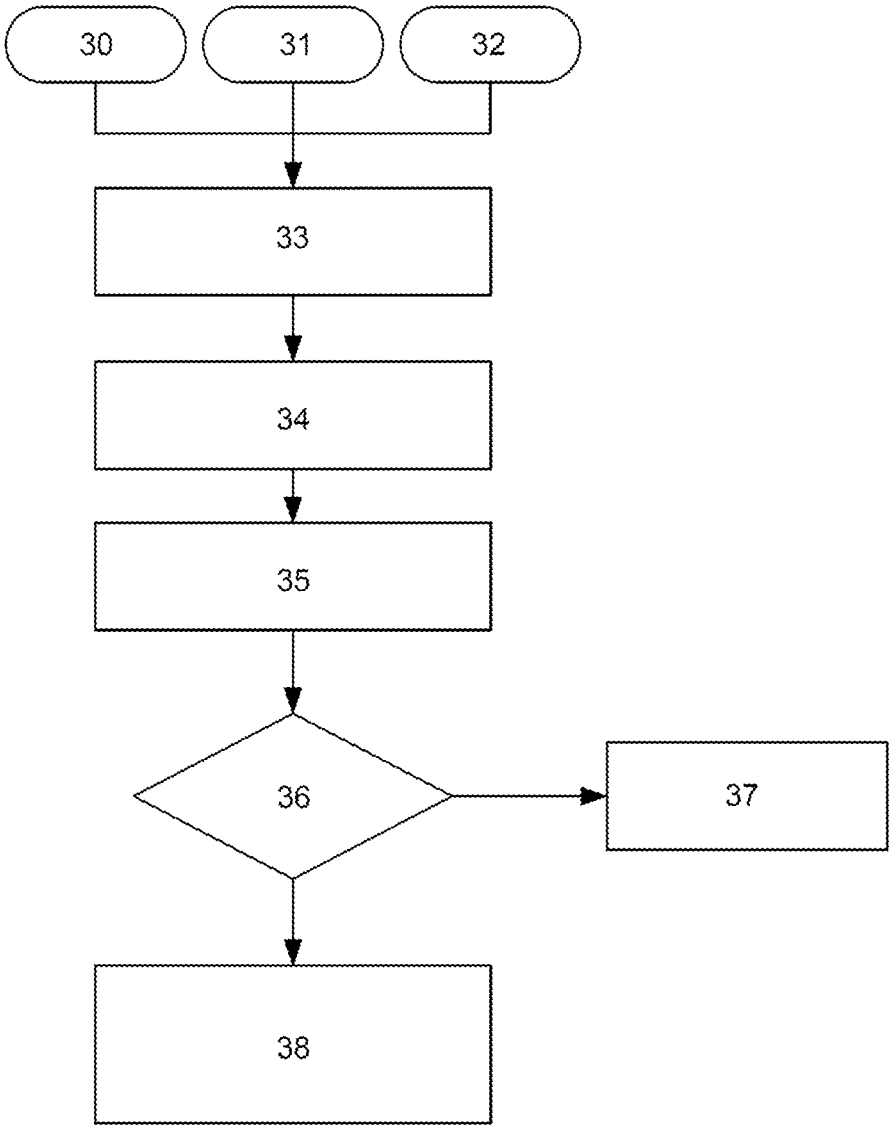
FIG. 6 shows a flow diagram for one preferred embodiment of the diagnosis method according to the present invention.

Referring more particularly to FIG. 6 which shows a flow diagram of one preferred embodiment of the diagnosis method according to the present invention with mention of steps which are not essential for the implementation of the method, the diagnosis method may be initiated under various conditions. For example, the method may be initiated upon an external request 30 in aftersales or in a garage, for example following a malfunction of the injection system in order to check beforehand whether or not the digital valve is faulty.

It may also be initiated upon a periodic routine request 31, initiated by a control unit for checking purposes or upon an internal request 32 initiated by a control unit, in particular following a possible fault detected in the injection system 1, an anomaly in the injection system 1 having been detected.

In step 33, the conditions for the implementation of the diagnosis method according to the invention may be checked. These conditions for implementation may be with the internal combustion engine of the vehicle stopped, a battery voltage of the motor vehicle, called upon to supply the diagnosis current, in a range between +/−20% of a nominal voltage of the battery, in order to have a current intensity that is neither too low nor too high.

In step 34, the digital valve may be driven so as to close under a diagnosis control current with a predetermined current intensity and predetermined current hold time.

In step 35, the measurements taken at a high frequency higher than 3 kHz of the diagnosis current added to the induced current flowing through a digital valve to be diagnosed in the predetermined hold time with an at least partial plot of the current curve may be analyzed in order to detect or otherwise an inflection on the current curve.

In step 36, the diagnosis is established: it is concluded that a digital valve is operating correctly or is faulty depending on whether or not a current inflection is detected in the predetermined hold time. If the digital valve is operating correctly, the information is sent in step 37 to an onboard control unit or to an external control unit. If the digital valve is faulty, the information is passed in step 38 to an onboard control unit or to an external control unit. A method for deblocking the faulty digital valve may then be implemented.

With reference to all of the figures, a method for deblocking a digital flow-control valve 13 for a high-pressure fuel injection pump forming part of a system 1 for injecting fuel into an internal combustion engine of a motor vehicle may incorporate the method for the diagnosis of a digital valve 13 as described above. When it is concluded that the digital valve 13 has a fault in the diagnosis method, a step of deblocking the digital valve 13 is performed.

There may be several deblocking procedures, also called unsticking procedures. One possible deblocking procedure is to subject the digital valve 13 to an unsticking control current applied in three consecutive phases having respective durations. In a first phase, the current varies from a minimum value to a maximum value. In a second phase, the current varies between the maximum value and a freewheeling value. Lastly, in a third phase, the current varies between the freewheeling value and the minimum value.

In the first phase, the current intensity may form a peak oscillating between the maximum intensity value and a value that is lower but close to the maximum intensity value.

The deblocking current comprising the three phases may be applied to the digital valve several times in succession.

Still referring to all of the figures, the invention lastly relates to a system 1 for injecting fuel into an internal combustion engine 12 of a motor vehicle comprising a high-pressure fuel injection pump 4 and a control unit 5, 6. The pump 4 comprises at least one piston 19 moving in a chamber and is equipped with a digital valve 13 for controlling a fuel flow rate and driven by the control unit 5, 6 via an electrical control element connected to the digital valve 13 by an electrical circuit and producing a nominal closing control electric current.

The injection system 1 implements a method for the functional diagnosis of a digital flow-control valve 13 or a method for deblocking a digital valve 13 as described above.

To that end, the electrical control element comprises means for varying the intensity and the hold time Dmain of the nominal current for application of a diagnosis current. The control unit 5, 6 comprises means for measuring the diagnosis current at a high frequency higher than 3 kHz, means for detecting an inflection 23 on a diagnosis current curve and means for establishing a diagnosis of a fault or otherwise in the digital valve 13.

The control unit may comprise means for transmitting the results of the diagnosis to an external unit and means for implementing a deblocking current for the digital valve 13.

The invention claimed is:

1. A method for the functional diagnosis of a digital flow-control valve (13) for a high-pressure fuel injection pump (4) forming part of a system (1) for injecting fuel into an internal combustion engine (12) of a motor vehicle, the digital control valve (13) controlling a flow rate of fuel in the pump by being electrically driven between an open position, with the digital valve (13) then taking an open position, in which a high-pressure portion of the injection system (1) is not supplied with fuel, and a closed position in which the high-pressure portion of the injection system (1) is supplied with the digital valve (13) taking a closed position, a nominal closing control electric current being applied to the digital valve (13) causing the digital valve to move toward the closed position and then canceled so that the digital valve opens under the action of a return spring, the movement of the digital valve (13) toward the closed position creating an induced current in the digital valve (13), wherein, in the diagnosis:

a closing diagnosis control current is applied to the digital valve (13), which closing diagnosis control current is different from the nominal control current with an intensity and for a hold time (Dmain) that are predetermined beforehand by experiment on digital valves identified as being fault-free, this intensity and this time being recognized as being sufficient for an inflection (23) on a curve of the closing current added to the induced current to be detected in the hold time (Dmain) predetermined for these fault-free digital valves, measurements are taken at a high frequency higher than 3 kHz of the diagnosis current added to the induced current flowing through a digital valve (13) to be diagnosed in the predetermined hold time (Dmain) with an at least partial plot of the current curve and, when an inflection (23) on the current curve is detected in this predetermined hold time (Dmain), a determination is made that the digital valve (13) is operating normally while, when no inflection (23) on the current curve is detected in this predetermined hold time (Dmain), a determination is made that the digital valve (13) is faulty.

2. The method as claimed in claim 1, wherein the diagnosis current is maintained after an end of the predetermined hold time (Dmain) for a predetermined additional time (Dsup), and when no inflection (23) on the current curve is detected in the predetermined hold time (Dmain) and the predetermined additional time (Dsup), a determination is made that the digital valve (13) has a first type of fault, a closing movement of the digital valve (13) not having taken place or not having been sufficient to position the digital valve (13) in the closed position, whereas, when no inflection (23) on the current curve is detected in the predetermined hold time (Dmain) but one is detected in the predetermined additional time (Dsup), a determination is made that the digital valve (13) has a second type of fault, a closing movement of the digital valve (13) having taken place too late.

3. The method as claimed in claim 1, wherein a decrease in current intensity in the inflection (23) is measured and, when this decrease in intensity is smaller than a predetermined inflection decrease threshold, a determination is made that the digital valve (13) has a third type of fault.

4. The method as claimed in claim 1, wherein the predetermined intensity of the diagnosis current is higher than a first, low threshold (Sibas) predetermined by experiment that is sufficient to cause the digital valve (13) to move into the closed position and lower than a predetermined second, high threshold in order to ensure electrical protection of the valve (13) and the control thereof, the predetermined hold time (Dmain) of a diagnosis control current being longer than the hold time of a nominal control current in normal operation of the digital valve (13).

5. The method as claimed in claim 1, wherein the diagnosis current applied to the digital valve (13) when the digital valve is closed is in the form of a plurality of peak-and-hold electrical pulses for a determined number of segments according to pulse-width modulation.

6. The method as claimed in claim 5, wherein the determined number of segments is smaller than 40 and the peak-and-hold is for four milliseconds, the high-frequency measurement of the current taking place at 10 kHz.

7. The method as claimed in claim 1, which is initiated upon an external request (30) in aftersales or in a garage, upon a periodic routine request (31) or upon a request (32) initiated following a possible fault detected in the injection system (1).

8. The method as claimed in claim 1, wherein the method is implemented with the engine of the motor vehicle running or stopped, and when the method is implemented with the engine stopped, a battery voltage of the motor vehicle, called upon to supply the diagnosis current, in a range between +/−20% of a nominal voltage of the battery.

9. A method for deblocking a digital flow-control valve (13) for a high-pressure fuel injection pump (4) forming part of a system (1) for injecting fuel into an internal combustion engine (12) of a motor vehicle, wherein the deblocking method incorporates a method for the diagnosis of the digital valve (13) as claimed in claim 1 and, when a determination is made that the digital valve (13) has a fault in the diagnosis method, a step of deblocking the digital valve (13) is performed.

10. The deblocking method as claimed in claim 9, wherein the digital valve (13) is subjected to an unsticking control current applied in three consecutive phases having respective durations with, in a first phase, a current varying from a minimum value to a maximum value, in a second phase, a current varying between the maximum value and a freewheeling value and, in a third phase, a current varying between the freewheeling value and the minimum value.

11. A system (1) for injecting fuel into an internal combustion engine (12) of a motor vehicle comprising a high-pressure fuel injection pump (4) and a control unit (5, 6), the pump (4) comprising at least one piston (19) moving in a chamber and being equipped with a digital valve (13) for controlling a fuel flow rate and driven by the control unit (5, 6) via an electrical control element connected to the digital valve (13) by an electrical circuit and producing a nominal closing control electric current, the system implementing a method for the functional diagnosis of a digital flow-control valve (13) as claimed in claim 1, wherein the electrical control element comprises means for varying the intensity and the hold time (Dmain) of the nominal current for application of a diagnosis current, the control unit comprising means for measuring the diagnosis current at a high frequency higher than 3 kHz, means for detecting an inflection (23) on a diagnosis current curve and means for establishing a diagnosis of a fault or otherwise in the digital valve (13).

12. The method as claimed in claim 2, wherein a decrease in current intensity in the inflection (23) is measured and, when this decrease in intensity is smaller than a predetermined inflection decrease threshold, a determination is made that the digital valve (13) has a third type of fault.

13. The method as claimed in claim 2, wherein the predetermined intensity of the diagnosis current is higher than a first, low threshold (Sibas) predetermined by experiment that is sufficient to cause the digital valve (13) to move into the closed position and lower than a predetermined second, high threshold in order to ensure electrical protection of the valve (13) and the control thereof, the predetermined hold time (Dmain) of a diagnosis control current being longer than the hold time of a nominal control current in normal operation of the digital valve (13).

14. The method as claimed in claim 3, wherein the predetermined intensity of the diagnosis current is higher than a first, low threshold (Sibas) predetermined by experiment that is sufficient to cause the digital valve (13) to move into the closed position and lower than a predetermined second, high threshold in order to ensure electrical protection of the valve (13) and the control thereof, the predetermined hold time (Dmain) of a diagnosis control current being longer than the hold time of a nominal control current in normal operation of the digital valve (13).

15. The method as claimed in claim 2, wherein the diagnosis current applied to the digital valve (13) when the digital valve is closed is in the form of a plurality of peak-and-hold electrical pulses for a determined number of segments according to pulse-width modulation.

16. The method as claimed in claim 3, wherein the diagnosis current applied to the digital valve (13) when the digital valve is closed is in the form of a plurality of peak-and-hold electrical pulses for a determined number of segments according to pulse-width modulation.

17. The method as claimed in claim 4, wherein the diagnosis current applied to the digital valve (13) when the digital valve is closed is in the form of a plurality of peak-and-hold electrical pulses for a determined number of segments according to pulse-width modulation.

18. The method as claimed in claim 2, which is initiated upon an external request (30) in aftersales or in a garage, upon a periodic routine request (31) or upon a request (32) initiated following a possible fault detected in the injection system (1).

19. The method as claimed in claim 3, which is initiated upon an external request (30) in aftersales or in a garage, upon a periodic routine request (31) or upon a request (32) initiated following a possible fault detected in the injection system (1).

20. The method as claimed in claim 4, which is initiated upon an external request (30) in aftersales or in a garage, upon a periodic routine request (31) or upon a request (32) initiated following a possible fault detected in the injection system (1).

* * * * *